US010612363B2

(12) United States Patent
Fripp et al.

(10) Patent No.: US 10,612,363 B2
(45) Date of Patent: Apr. 7, 2020

(54) ELECTRIC SUBMERSIBLE PUMP EFFICIENCY TO ESTIMATE DOWNHOLE PARAMETERS

(71) Applicant: Halliburton Energy Services, Inc., Houston, TX (US)

(72) Inventors: Michael Linley Fripp, Dallas, TX (US); Jason D. Dykstra, Carrollton, TX (US); Fanping Bu, Carrollton, TX (US); John C. Gano, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 317 days.

(21) Appl. No.: 15/307,326

(22) PCT Filed: May 30, 2014

(86) PCT No.: PCT/US2014/040293
§ 371 (c)(1),
(2) Date: Oct. 27, 2016

(87) PCT Pub. No.: WO2015/183312
PCT Pub. Date: Dec. 3, 2015

(65) Prior Publication Data

US 2017/0067334 A1 Mar. 9, 2017

(51) Int. Cl.
*E21B 47/00* (2012.01)
*E21B 43/12* (2006.01)

(52) U.S. Cl.
CPC ..... *E21B 47/0007* (2013.01); *E21B 43/128* (2013.01)

(58) Field of Classification Search
CPC . E21B 43/128; E21B 47/0007; G01R 31/343; G05B 23/0283; F04D 15/0088; F04D 15/0209; F04D 9/001
See application file for complete search history.

(56) References Cited

U.S. PATENT DOCUMENTS

| | | | | |
|---|---|---|---|---|
| 5,269,659 | A | 12/1993 | Hampton et al. | |
| 2009/0250210 | A1* | 10/2009 | Allen | F04D 9/001 166/250.15 |
| 2013/0108472 | A1 | 5/2013 | Pons | |
| 2013/0108479 | A1 | 5/2013 | Branecky et al. | |
| 2013/0317762 | A1 | 11/2013 | Camilleri | |
| 2015/0176389 | A1* | 6/2015 | Hsu | E21B 49/08 166/250.01 |

FOREIGN PATENT DOCUMENTS

| | | | |
|---|---|---|---|
| JP | 2945811 | B2 | 9/1999 |
| WO | 2015183312 | A1 | 12/2015 |

* cited by examiner

*Primary Examiner* — Kyle R Quigley
(74) *Attorney, Agent, or Firm* — John Wustenberg; Parker Justiss, P.C.

(57) ABSTRACT

Some examples can be implemented to determine electric submersible pump efficiency to estimate downhole parameters. At a computer system, a load signal on an in-well type electric submersible pump to transfer fluid through a wellbore is received. At the computer system, a load represented by the received load signal and an expected load on the pump is compared. A difference between the load represented by the received load signal and the expected load based on comparing the load represented by the received load signal and the expected load on the pump is identified.

20 Claims, 2 Drawing Sheets

ELECTRIC SUBMERSIBLE PUMP EFFICIENCY TO ESTIMATE DOWNHOLE PARAMETERS

CROSS-REFERENCE TO RELATED APPLICATION

This application is the National Stage of, and therefore claims the benefit of, International Application No. PCT/US2014/040293 filed on May 30, 2014, entitled "ELECTRIC SUBMERSIBLE PUMP EFFICIENCY TO ESTIMATE DOWNHOLE PARAMETERS," which was published in English under International Publication Number WO 2015/183312 on Dec. 3, 2015. The above application is commonly assigned with this National Stage application and is incorporated herein by reference in its entirety.

TECHNICAL FIELD

This disclosure relates to determining downhole parameters in a wellbore.

BACKGROUND

Wellbore operations can be performed using equipment positioned and implemented downhole. For example well production operations can be implemented by positioning a pump downhole to provide pressure to drive production fluid uphole, i.e., toward a surface. The well production operation can be inefficient if the pump does not operate properly. The pump may not operate properly due to a defect in the pump, due to a change in the environment in which the pump operates, combinations of them or for other reasons. For example, the pump may not operate properly when there is excess gas in the production fluid.

DESCRIPTION OF DRAWINGS

Like reference symbols in the various drawings indicate like elements.

DETAILED DESCRIPTION

Figure 1:
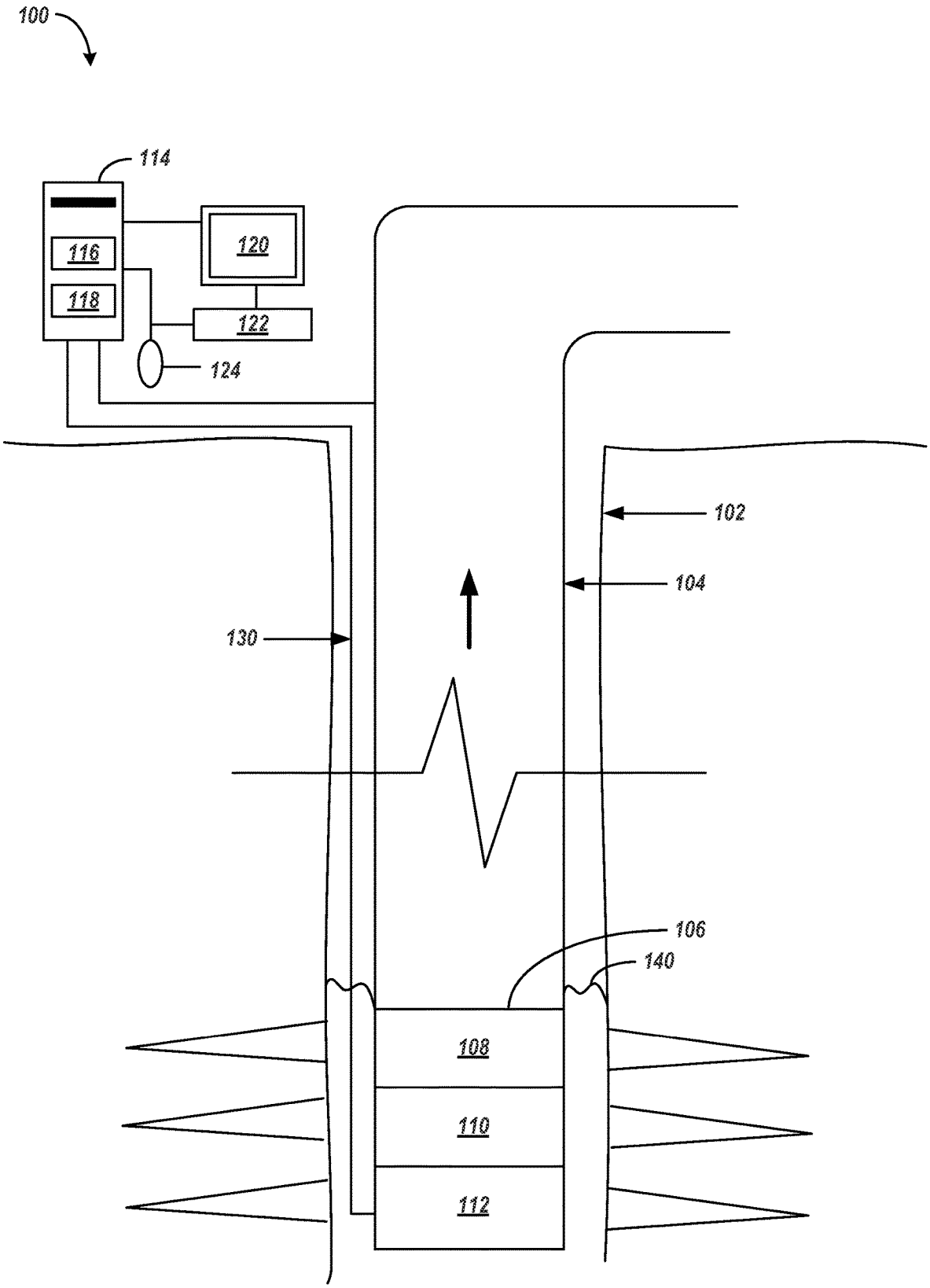
FIG. 1 is a schematic diagram of a well system implementing downhole equipment.

This disclosure describes using electric submersible pump (ESP) efficiency to estimate downhole parameters. An ESP is positioned in the wellbore, e.g., partially or entirely submerged in the production fluid being pumped uphole or at another location in the wellbore. The ESP is operated to provide drive pressure to the production fluid (e.g., oil, gas, water, combinations of them, or other production fluid) which helps the production fluid to surface. During ESP operation, power is delivered from the surface to the pump in wellbore. The ESP can be operated efficiently when the electrical power into the ESP is converted into fluid flow at the surface. An inefficient ESP operation can be caused by a poorly performing ESP, a change in the production fluid state (e.g., an increase in gas content of the production fluid or a change in fluid properties, such as density, viscosity or other property), combinations of them, or for other reasons. For example, excessive gas due to a poorly functioning liquid-gas separator or of a liquid line being too close to the ESP intake can degrade the performance of an ESP.

This disclosure describes techniques to determine downhole parameters of the wellbore based on parameters that can be determined at the surface of the wellbore. For example, by comparing the load on or the efficiency of the ESP with flow rates out of the ESP, an indication of the downhole free gas cut can be determined. The efficiency can be represented as fluid power out of the ESP divided by electrical power in. The fluid power out can be determined using a flow rate at the ESP. The electrical power in to the ESP can be determined using, e.g., a voltage and current supplied to the ESP. Using these parameters observed or determined at the surface, downhole parameters, e.g., free gas cut, can be determined. Determining downhole parameters at the surface can include determining the parameters outside the wellbore, e.g., onsite or off-site. Determining the downhole parameters at the surface can also include determining the parameters near the surface, e.g., at locations that are significantly closer to the surface than to the downhole equipment. Such locations can be within and near the entrance of the wellbore.

Monitoring the efficiency of downhole equipment such as an ESP, e.g., by observing and determining performance-related parameters at the surface, can allow effective estimation of downhole parameters associated with production fluid flow and/or the artificial lift process. The efficiency measurements can indicate formation properties, e.g., presence of free gas, excessive erosion, or other formation properties, and can indicate pump health properties, e.g., excessive bearing (and/or other) friction, poor pump motor health, poor electrical connections, poor cable health or other health properties that can affect ESP efficiency. Tracking the ESP efficiency can allow diagnosing the source of the inefficiency and taking appropriate action to address the source. For example, reducing pump rate may eliminate inefficiencies related to a low fluid level but may not reduce the inefficiencies for excessive bearing friction. Tracking the efficiency change as a function of power delivered to the ESP can serve as a useful diagnostic tool. The operations described here can be implemented while the ESP is in operation allowing real-time response to deviations from expected and actual ESP performance.

Figure 2:
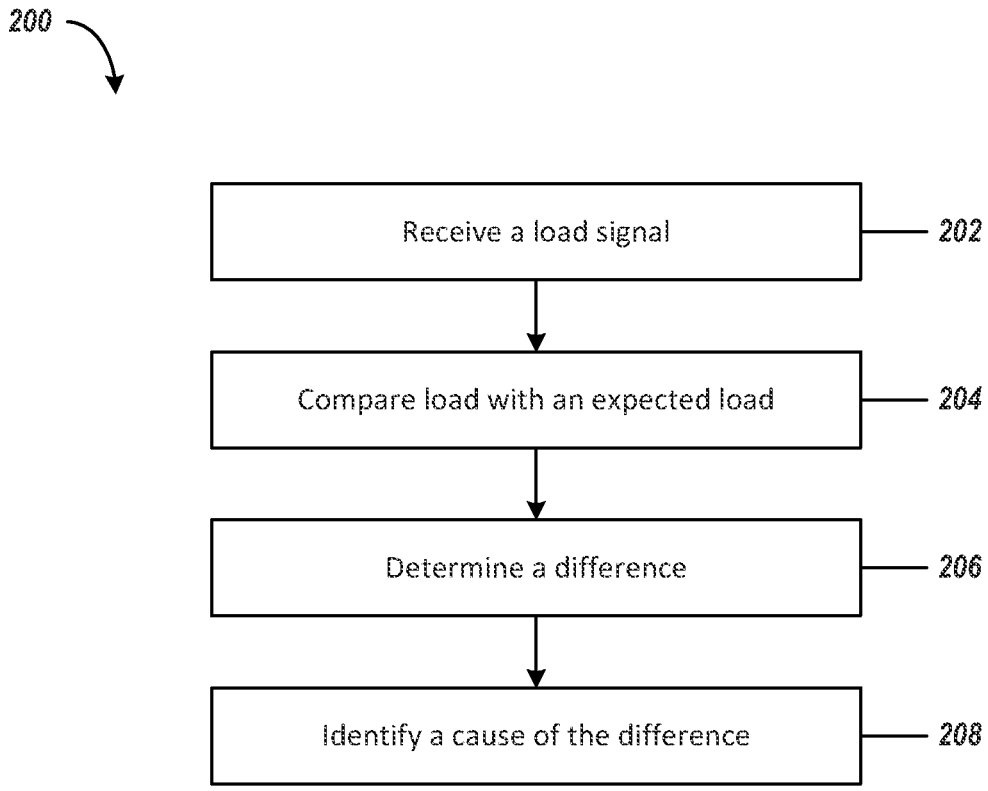
FIG. 2 is a flowchart of an example process for determining efficiency of downhole equipment to estimate downhole parameters.

FIG. 1 is a schematic diagram of a well system 100 implementing downhole equipment. FIG. 2 is a flowchart of an example process 200 for determining efficiency of the downhole equipment implemented in the well system 100 to estimate downhole parameters. The well system 100 includes a wellbore 102 formed through a subterranean zone (e.g., a formation, a portion of a formation or multiple formations). At least a portion of the wellbore 102 can be cased with a casing 104. Downhole equipment, e.g., an in-well type ESP 106 can be positioned in the wellbore 102. For example, the ESP 106 can be positioned in the wellbore 102 below a production fluid line 140. The ESP 106 can include multiple components including, e.g., a pump motor 112, a liquid-gas separator 110, pump stages 108, sensors (not shown) and other components. The ESP 106 can be connected to surface equipment (described below) using ESP cables 130 through which power or data (or both) can be communicated.

The surface equipment can include a computer system 114 to which the ESP cables 130 are connected. The computer system 114 can include a computer-readable medium 116 storing computer instructions executable by data processing apparatus 118 (e.g., one or more processors) to perform operations including all or portions of process 200 described below. The computer system 114 can be connected to output devices (e.g., a monitor 120 or other output devices) and input devices (e.g., a keyboard 122, a mouse 124 or other input devices). In some implementations, the computer system 114 can be a desktop computer, a laptop computer, a tablet computer, a personal digital assistant (PDA), a smartphone or other computer system. The surface equipment can also include a power source to provide power, e.g., voltage and current signals, to the ESP 130. In some implementations, the computer system 114 can include and control the power source, while in others, the computer system 114 and the power source can be separate units that are independent of each other.

At 202, a load signal on the in-well type ESP 106 to transfer fluid through a wellbore is received. For example, the surface equipment can include one or more sensors (not shown) disposed at the surface of the wellbore 102 to sense surface parameters that represent a load on the ESP 106 during operation. The one or more sensors can sense parameters e.g., a volumetric flow out of the wellbore 102, a mass flow out of the wellbore 102, a pressure of the flow after the ESP 106 such as at the surface, velocity of flow at the surface, a temperature of the flow at the surface, a pressure differential between an outlet at the surface and at the ESP 106, between the outlet and the annulus, across the ESP 106 (or combinations of them), a rotational speed of the ESP 106, combinations of them or other parameters. For example, the one or more sensors can sense parameters away from the ESP 106, e.g., at or near the surface of the wellbore 102. The computer system 114 can receive one or more load signals from each of the one or more sensors and store the received load signals, e.g., as computer-readable data in the computer-readable medium 118.

In some implementations, a sensor can sense and provide multiple load signals, each at a corresponding time instant. For example, the flow meter can sense and provide a first volumetric flow rate ($Q_1$), a second volumetric flow rate ($Q_2$), a third volumetric flow rate ($Q_3$), and so on, at a first time instant ($t_1$), a second time instant ($t_2$), a third time instant ($t_3$), and so on, respectively. The time instances can be at regular intervals, or in certain instances, irregular intervals. In such implementations, the computer system 114 can receive and store each set of load signals and time instants at which the load signals were sensed and provided. The computer system 114 can also store information describing a duration for which the ESP 106 has been operational and inputs to the ESP 106 (e.g., voltage signals and current signals from the power source). For example, the computer system 114 can store, in a row of a table, a time instant, values represented by load signals measured at the surface and/or downhole at the time instant, and values represented by inputs provided to the ESP 106 at the time instant. The computer system 114 can store similar values for multiple time instants in multiple rows of the table. Alternatively, the computer system 114 can implement other storage formats to store the time instants, the values represented by the load signals and the values represented by the inputs.

The load signals represent a load on, e.g., an effort by, the ESP 106 to perform pumping operations under operating conditions. The conditions can include a well fluid parameter (e.g., a liquid and/or gaseous state of production fluids, a quantity of gas, or other well fluid parameters) or an ESP pump parameter (e.g., bearing friction, component wear or other ESP pump parameter), or both. Such parameters can change over time. Collecting and storing the load signals over time enables monitoring the load on the ESP 106 over time to determine if the ESP 106 is operating as expected.

An expected operation of the ESP 106 can be determined using the ESP's operational ratings. An expected operation of the ESP 106 can represent an operation that the ESP 106 is rated to perform under specified conditions. For example, the in-well type ESP manufacturer identifies and provides expected loads on an in-well type ESP under specified conditions including, e.g., specified well fluid parameter or in-well ESP parameters. The specified well fluid parameter can include, e.g., a temperature and/or pressure at the downhole wellbore location in which the ESP 106 will be positioned. The in-well type ESP parameter can include, e.g., a power provided to the ESP 106 and/or an operational duration of the ESP 106.

Alternatively, a test ESP that is similar to the ESP 106 can be tested, e.g., at the surface under laboratory conditions, to develop expected loads on ESPs such as the ESP 106. To identify the expected loads, different specified inputs can be provided to the test ESP during different tests including, e.g., varying load tests, fatigue tests, and other tests. Load signals representing loads on the test ESP under different test conditions and at multiple time instants can be determined. The computer system 114 can store the expected loads and the inputs, e.g., as computer-readable data on the computer-readable medium 118. In some implementations, the computer system 114 can store the expected loads and the inputs in rows of a table as described above.

At 204, a load represented by the received load signal and an expected load on the ESP 106 can be compared. For example, the computer system 114 can compare a load represented by the load signal at a time instant with an expected load determined as described above. In one example, the load signal can represent a volumetric flow rate at the surface of the wellbore 106 over a certain number of hours of operation at the ESP 106. In implementations in which the ESP 106 is being driven by an alternating current (AC) signal, a phase angle between the voltage represented by a voltage signal and the current represented by a current signal can be indicative of the load on the ESP 106. In another example, a rotational speed of the pump motor 112 can be indicative of the load on the ESP 106. The phase angle can be obtained without interfacing with the pump motor 112. For example, the phase angle can be obtained based on a real part of a wire resistance and imaginary part of coil inductance of the pump motor 112.

To compare the received load signal and the expected load on the ESP 106, the computer system 114 can identify a value (or values) represented by the load signal, a value (or values) represented by each of an expected well fluid parameter or an expected in-well ESP parameter, and a value (or values) represented by an actual well fluid parameter or an actual in-well ESP parameter at a time instant at which the load signal was sensed. In some implementations, the computer system 114 can compare a load represented by the received load signal and the expected load on the ESP 106 in real-time. That is, the computer system 114 can receive the load signals during the operation of the ESP 106. Concurrently upon receipt of the load signals (or as immediately after receipt of the load signals that the computer system 114 processing power allows), the computer system 114 can identify the load on the ESP 106 from the received load signal. Also, upon receipt, the computer system 114 can identify the expected load on the ESP 106, e.g., by reading data from the computer-readable medium 118. Because the computer system 114 receives multiple load signals over time, the computer system 114 can compare the loads represented by the multiple load signals and corresponding expected loads on the ESP 106 over time.

At 206, a difference between the load represented by the received load signal and the expected load is determined based on comparing the load represented by the received load signal and the expected load on the pump. For example, the computer system 114 can determine the difference between the load represented by the received load signal and the expected load. In some implementations, the computer system 114 can provide the difference to an output device, e.g., the monitor 120. For example, the computer system 114 can generate a two-dimensional chart (e.g., an XY plot) showing a difference between the load represented by the received load signal and the expected load on a Y-axis and a time on the X-axis. The computer system 114 can provide the difference to the output device in other formats. For example, the computer system 114 can generate a two-dimensional chart that shows the load represented by the received load signal and the expected load over time as an alternative to or in addition to showing the difference over time.

At 208, a cause of a difference between the load represented by the received load signal and the expected load is identified based on comparing the load represented by the received load signal and the expected load on the pump. For example, either an operator at the wellbore 102 or the computer system 114 can identify the cause of the difference. In some implementations, the operator at the wellbore 102 can identify the cause of the difference by viewing the output provided by the computer system 114. For example, pump operation can be varied (by the operator or the computer system 114) to aid in determining the cause of the difference. Alternatively or in addition, other parameters, e.g., flow rate and measured fluid characteristics, can be evaluated (by the operator or the computer system 114) to determine the cause of the difference.

The load is related to the force being delivered by the ESP 106. The load on the ESP 106 at a given instant indicates whether the ESP 106 is performing as intended at that instant. The cause of the difference can be that either a well fluid parameter or an in-well ESP parameter generated responsive to the load represented by the received load signal diverges from the expected well fluid parameter or the expected in-well ESP parameter, respectively. For example, a low force on the ESP 106 may indicate that the ESP 106 is not coupling to the fluid which might happen if there was excessive gas content in the pump stages 108. Alternatively, or in addition, one or more of excessive ESP friction, poor pump motor health, poor electrical connections, or poor cable health can be identified as the cause of the difference between the load represented by the received load signal and the expected load.

In some implementations, the computer system 114 can determine a first time rate of divergence between the load represented by the received load signal and the expected load. The computer system 114 can further determine that the first time rate of divergence is greater than a threshold rate of divergence. Responsively, either the operator at the wellbore 102 or the computer system 114 can determine that the well fluid parameter generated responsive the load represented by the received load signal diverges from the expected well fluid parameter. For example, the well fluid parameter can be cavitation due to an increase (sometimes, a sudden increase) in a quantity of gas in the production fluid. The cavitation can be caused due to a change in well fluid density due to a presence of gas in the well fluid. Due to cavitation, the rotational speed of the pump motor 112 can increase rapidly, e.g., because the pump motor 112 is pumping gas rather than liquid. The load represented by the received load signal can be the rotational speed of the pump motor 112, and the time rate of divergence of the rotational speed can represent an acceleration of the pump motor 112. An operator of the wellbore 102 can store a threshold rate of divergence in the computer system 114, which can represent a maximum threshold acceleration of the pump motor 112. The computer system 114 can periodically compare the acceleration of the pump motor 112 against the threshold acceleration. When the computer system 114 determines that the acceleration of the pump motor 112 exceeds the threshold acceleration, then the computer system 114 can provide an output, e.g., a notification. The operator of the wellbore 102 can take action in response to receiving the notification. For example, the operator can decrease power input to the pump motor 112 or cease pump motor operation or take other action.

In some implementations, the computer system 114 can determine a second time rate of divergence between the load represented by the received load signal and the expected load. The computer system 114 can further determine that the second time rate of divergence is less than a threshold rate of divergence. Responsively, either the operator at the wellbore 102 or the computer system 114 can determine that the pump parameter generated responsive the load represented by the received load signal diverges from the expected pump parameter. For example, the pump parameter can include friction in pump bearings. The friction can increase as the bearings wear. Due to bearing friction, the rotational speed of the pump motor 112 can decrease, e.g., because the ESP 106 has to do additional work to overcome the bearing friction. The load represented by the received load signal can be the rotational speed of the pump motor 112, and the time rate of divergence of the rotational speed can represent an acceleration of the pump motor 112. As described above, the operator of the wellbore 102 can store a threshold rate of divergence in the computer system 114, which can represent a minimum threshold acceleration of the pump motor 112. The computer system 114 can periodically compare the acceleration of the pump motor 112 against the threshold acceleration. When the computer system 114 determines that the acceleration of the pump motor 112 is less than the threshold acceleration, then the computer system 114 can provide an output, e.g., a notification. The operator of the wellbore 102 can take action in response to receiving the notification. For example, the operator can cease pump motor operation or take other action.

In the example implementations described above, the loads on the ESP 106 were used to compare actual and expected operations of the ESP 106. In some implementations, an efficiency of the ESP 106 can be used to compare the actual and expected operations. For example, using the received one or more load signals, the computer system 114 can determine an efficiency of the ESP 106. In some implementations, the efficiency of the ESP 106 can be defined as a ratio of fluid power out and electrical power in. The fluid power out can be represented, e.g., by the volumetric flow rate out of the wellbore 102 at the surface. The electrical power in can be represented by a product of voltage and current that the power source provides to the ESP 106. The power source can provide DC signals or AC signals, in which case the electrical power can additionally be represented by phase angles of the voltage and current signals. In some implementations, the efficiency of the ESP 106 can be defined as a ratio of a rotational speed of the ESP 106 and the electrical power in.

The computer system 114 can determine and/or receive an expected efficiency for an expected load. For example, the computer system 114 can determine the output of the pump at a surface of the wellbore 102, and determine the expected efficiency based on the expected output of the pump at the expected load. The computer system 114 can store the expected efficiencies for different expected loads. The computer system 114 can determine an efficiency of the ESP 106 based on the load represented by the received load signal. To do so, for example, as described above, the computer system 114 can determine an output of the pump and divide the output by the load represented by the received load signal. The computer system 114 can compare the determined efficiency and an expected efficiency for the expected load. Based on the comparison, the computer system 114 can provide an output, e.g., a notification on the output device. The operator of the wellbore 102 can perform actions based on the notification.

Certain aspects of the subject matter described here can be implemented as a method. At a computer system, a load signal on an in-well type electric submersible pump to transfer fluid through a wellbore is received. At the computer system, a load represented by the received load signal and an expected load on the pump is compared. A a difference between the load represented by the received load signal and the expected load based on comparing the load represented by the received load signal and the expected load on the pump is identified.

This, and other aspects, can include one or more of the following features. A cause of the difference between the load represented by the received load signal and the expected load is identified. The expected load can represent a load on the pump operated in the wellbore under an specified well fluid parameter or an specified in-well electric submersible pump parameter. Identifying the cause of the difference can include determining, based on the difference, that either a well fluid parameter or an in-well electric submersible pump parameter generated responsive to the load represented by the received load signal diverges from the specified well fluid parameter or the specified in-well electric submersible pump parameter, respectively. Identifying the cause of the difference can include determining a first time rate of divergence between the load represented by the received load signal and the expected load. It can be determined that the well fluid parameter generated responsive to the load represented by the received load signal diverges from the specified well fluid parameter in response to determining that the first time rate of divergence is greater than a threshold time rate of divergence. The well fluid parameter can include a change in well fluid density due to a presence of gas in the well fluid. Identifying the cause of the difference can include determining a second time rate of divergence between the load represented by the received load signal and the expected load. It can be determined that the pump parameter generated responsive to the load represented by the received load signal diverges from the specified pump parameter in response to determining that the second time rate of divergence is less than a threshold time rate of divergence. The pump parameter can include friction in pump bearings. The pump can be operated downhole in the wellbore. The receiving, the comparing, and the identifying can be implemented at a surface of the wellbore. An efficiency of the pump can be determined based on the load represented by the received load. The determined efficiency and an expected efficiency for the expected load can be compared. Determining the efficiency of the pump based on the load represented by the received load signal can include determining an output of the pump, and dividing the output of the pump by the load represented by the received load signal. Determining the output of the pump can include determining the output at a surface of the wellbore. The expected efficiency can be determined based on an expected output of the pump and the expected load. Receiving the load signal can include receiving at least one of a voltage and a current provided to the pump, a phase angle of an alternating current and a phase angle of voltage provided to the pump, or a power provided to the pump.

Certain aspects of the subject matter described here can be implemented as a computer-readable medium storing instructions executable by one or more processors to perform operations. At a surface of a wellbore, a load signal on an in-well type electric submersible pump to transfer fluid through the wellbore is received. A load represented by the received load signal is compared with an expected load on the pump. A difference between the load represented by the received load signal and the expected load is determined based on comparing the load represented by the received load signal and the expected load on the pump.

This, and other aspects, can include one or more of the following features. The expected load can represent a load on the pump operated in the wellbore under an expected well fluid parameter or an expected in-well electric submersible pump parameter. Determining the difference can include determining, based on the difference, that either a well fluid parameter or an in-well electric submersible pump parameter generated responsive to the load represented by the received load signal diverges from the expected well fluid parameter or the expected in-well electric submersible pump parameter, respectively. Determining the difference can include determining a first time rate of divergence between the load represented by the received load signal and the expected load. It can be determined that the well fluid parameter generated responsive to the load represented by the received load signal diverges from the expected well fluid parameter in response to determining that the first time rate of divergence is greater than a threshold time rate of divergence. The well fluid parameter can include a change in well fluid density due to a presence of gas in the well fluid. Determining the difference can include determining a second time rate of divergence between the load represented by the received load signal and the expected load. It can be determined that the pump parameter generated responsive to the load represented by the received load signal diverges from the expected pump parameter in response to determining that the second time rate of divergence is less than a threshold time rate of divergence. The pump parameter can include friction in pump bearings.

Certain aspects of the subject matter described here can be implemented as a system including one or more processors, and a computer-readable medium storing instructions executable by the one or more processors to perform operations described here.

A number of implementations have been described. Nevertheless, it will be understood that various modifications may be made without departing from the spirit and scope of the disclosure.

The invention claimed is:

1. A method comprising:

receiving, at a computer system, a load signal on an in-well type electric submersible pump to transfer fluid uphole to a surface through a wellbore;

comparing, at the computer system, a load represented by the received load signal and an expected load on the pump; and identifying a difference between the load represented by the received load signal and the expected load based on comparing the load represented by the received load signal and the expected load on the pump, wherein identifying the difference comprises:

determining a time rate of divergence between the load represented by the received load signal and the expected load; and determining that a well fluid parameter generated responsive to the load represented by the received load signal diverges from a specified well fluid parameter in response to determining that the time rate of divergence is greater than a threshold time rate of divergence.

2. The method of claim 1, wherein the method further comprises identifying a cause of the difference between the load represented by the received load signal and the expected load.

3. The method of claim 2, wherein the expected load represents a load on the pump operated in the wellbore under the specified well fluid parameter or a specified in-well electric submersible pump parameter, and wherein identifying the cause of the difference comprises determining, based on the difference, that either the well fluid parameter or the in-well electric submersible pump parameter generated responsive to the load represented by the received load signal diverges from the specified well fluid parameter or the specified in-well electric submersible pump parameter, respectively.

4. The method of claim 1, wherein the well fluid parameter includes a change in well fluid density due to a presence of gas in the well fluid.

5. The method of claim 1, wherein identifying the difference comprises:

determining another time rate of divergence between the load represented by the received load signal and the expected load;

determining that a pump parameter generated responsive to the load represented by the received load signal diverges from the specified pump parameter in response to determining that the other time rate of divergence is less than a threshold time rate of divergence.

6. The method of claim 5, wherein the pump parameter includes friction in pump bearings.

7. The method of claim 1, wherein the pump is operated downhole in the wellbore, and wherein the receiving, the comparing, and the identifying are implemented at the surface of the wellbore.

8. The method of claim 1, further comprising:

determining an efficiency of the pump based on the load represented by the received load signal; and comparing the determined efficiency and an expected efficiency for the expected load.

9. The method of claim 8, wherein determining the efficiency of the pump based on the load represented by the received load signal comprises:

determining an output of the pump; and dividing the output of the pump by the load represented by the received load signal.

10. The method of claim 9, wherein determining the output of the pump comprises determining at least one of a volumetric flow rate of fluid pumped by the pump, a mass flow rate of fluid pumped by the pump, a pressure of fluid pumped by the pump, or a velocity of fluid pumped by the pump.

11. The method of claim 9, wherein determining the output of the pump comprises determining the output at the surface of the wellbore.

12. The method of claim 8, further comprising determining the expected efficiency based on an expected output of the pump and the expected load.

13. The method of claim 1, wherein receiving the load signal comprises receiving at least one of a voltage and a current provided to the pump, a phase angle of an alternating current and a phase angle of voltage provided to the pump, or a power provided to the pump.

14. The method of claim 1, wherein the load signal is determined based on a volumetric flow out of the wellbore.

15. A non-transitory computer-readable medium storing instructions executable by one or more processors to perform operations comprising:

receiving, at surface of a wellbore, a load signal on an in-well type electric submersible pump to transfer fluid uphole to a surface through the wellbore;

comparing a load represented by the received load signal and an expected load on the pump; and determining a difference between the load represented by the received load signal and the expected load based on comparing the load represented by the received load signal and the expected load on the pump, wherein determining the difference comprises:

determining a time rate of divergence between the load represented by the received load signal and the expected load; and determining that a well fluid parameter generated responsive to the load represented by the received load signal diverges from an expected well fluid parameter in response to determining that the time rate of divergence is greater than a threshold time rate of divergence.

16. The medium of claim 15, wherein the expected load represents a load on the pump operated in the wellbore under the expected well fluid parameter or an expected in-well electric submersible pump parameter, and wherein determining the difference comprises determining, based on the difference, that either the well fluid parameter or the in-well electric submersible pump parameter generated responsive to the load represented by the received load signal diverges from the expected well fluid parameter or the expected in-well electric submersible pump parameter, respectively.

17. The medium of claim 16, wherein the well fluid parameter includes a change in well fluid density due to a presence of gas in the well fluid.

18. The medium of claim 15, wherein determining the difference comprises:

determining another time rate of divergence between the load represented by the received load signal and the expected load;

determining that the pump parameter generated responsive to the load represented by the received load signal diverges from the expected pump parameter in response to determining that the other time rate of divergence is less than a threshold time rate of divergence.

19. The medium of claim 18, wherein the pump parameter includes friction in pump bearings.

20. The medium of claim 15, wherein the load signal is determined based on a volumetric flow out of the wellbore.

* * * * *